US006964259B1

(12) United States Patent
Raetzman

(10) Patent No.: US 6,964,259 B1
(45) Date of Patent: Nov. 15, 2005

(54) NONADJUSTABLE OUTBOARD MOTOR THROTTLE LINKAGE

(75) Inventor: Roger W. Raetzman, Kenosha, WI (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/708,081

(22) Filed: Feb. 6, 2004

(51) Int. Cl.[7] ..... F02D 9/10
(52) U.S. Cl. ..... 123/400; 123/337; 440/87
(58) Field of Search ..... 123/336, 337, 123/400; 74/480 B, 513; 440/1, 84, 87

(56) References Cited

U.S. PATENT DOCUMENTS 3,183,879 A * 5/1965 Heidner ..... 440/87
4,062,334 A 12/1977 Toda et al.
4,195,534 A * 4/1980 Prince ..... 74/480 B
4,239,710 A 12/1980 Sato
4,317,784 A 3/1982 Kato et al.
4,577,608 A 3/1986 DuBois et al.
4,823,748 A 4/1989 Ampferer et al.
4,943,141 A 7/1990 Mori
4,971,006 A 11/1990 Imaeda
4,976,636 A * 12/1990 Torigai et al. ..... 440/87
4,995,370 A 2/1991 Imaeda et al.
5,022,736 A 6/1991 Mori
RE34,138 E * 12/1992 Flaig et al. ..... 123/400
5,273,016 A * 12/1993 Gillespie et al. ..... 440/87
5,517,963 A 5/1996 Yoshida et al.
5,517,977 A 5/1996 Nakai et al.
5,729,387 A 3/1998 Takahashi et al.
5,803,044 A 9/1998 Kato
5,921,225 A 7/1999 Nakamura
6,484,706 B1 * 11/2002 Mate ..... 123/583

* cited by examiner

*Primary Examiner*—Tony M. Argenbright
(74) *Attorney, Agent, or Firm*—BRP Legal Services

(57) ABSTRACT

A throttle linkage for use with an internal combustion engine is disclosed which connects a throttle actuator to a throttle assembly. The throttle linkage is nonadjustable and interacts with a plurality of throttle stops integrally formed with an engine block. Such an arrangement prevents tampering in advanced two-stroke engines and ensures emission output at a level well below that allowed.

29 Claims, 7 Drawing Sheets

NONADJUSTABLE OUTBOARD MOTOR THROTTLE LINKAGE

BACKGROUND OF INVENTION

The present invention relates generally to engine throttle controls, and more particularly, to a nonadjustable throttle linkage connecting a throttle assembly to a throttle input.

During operation of most internal combustion engines, an operator increases the operating speed of the engine by increasing a throttle actuator. In highway vehicles, the throttle actuator is commonly referred to as a gas pedal or, in motorcycle-type devices, a twist hand grip accelerator. In non-highway use engine equipped devices, the accelerator is often generically referred to as the throttle or a throttle actuator. In watercraft, the throttle actuator is often located near a control station, or bridge, and is often a hand lever having linear motion that an operator adjusts in order to manipulate the operating speed of an engine in communication therewith.

The throttle actuator is often connected to a throttle linkage assembly that is connected to a throttle assembly mounted directly about an engine. The throttle assembly generally includes a throttle body having an opening therethrough, a throttle plate positioned in the opening of the throttle body, and an actuator connected to the throttle plate. Commonly, the throttle linkage connects the throttle assembly to the operator controlled throttle actuator such that movement of the throttle actuator results in a change of position of the throttle plate of the throttle assembly. As an operator desires to increase the operating speed of the engine, and the engine demands more combustion gas in response to the desired increase in engine speed, the operator advances the throttle actuator which in turn rotates the throttle plate relative to the throttle body opening.

Generally, as an engine is accelerated, the combustion process requires more fuel and more combustion air. As an operator advances the throttle actuator, the throttle plate opens, thereby allowing more combustion air to pass to the combustion chambers of the engine. The movement of the throttle plate relative to the movement of the throttle actuator is partly dependent on the throttle linkage disposed therebetween. In an effort to better control the responsiveness of the engine and allowance for tolerance, the throttle linkage disposed between the throttle assembly and the throttle actuator often includes some form of adjustment, such as independently adjustable links. In older engines, the adjustability of the links was also used to set idle speed.

The throttle linkage assembly can also be adjustable relative to a plurality of throttle stops. Such adjustment means often includes a plurality of screws that restricts the movement of individual links. Movement of the throttle links is often minimally fixed between fixed throttle stops. The throttle linkage is often adjusted relative to a first throttle stop to set an idle throttle linkage position that corresponds to an idle engine speed. Adjusting the throttle linkage relative to the first throttle stop often determines the relation of the throttle linkage to the throttle plate to ensure smooth and repeatable idle engine operation. As these older engines are operated, an operator could acoustically determine when the preferred idle orientation occurs. In much the same way, a second throttle stop is often implemented to set a wide open throttle position. Improper adjustment of the throttle linkage from the first or second throttle stops results in rough running engine idle speed, engine stall, or a fast running idle engine speed. Additionally, operating an engine at any of these conditions for extended periods of time results in inefficient use of engine fuel and detrimentally affects engine emissions.

Drawbacks to the adjustability of the throttle linkage assembly includes the adjustment means inadvertently coming loose and operator tampering. If the throttle linkage adjustment inadvertently comes loose, the engine may be operated outside a preferred range without operator knowledge. While any change in the operation of the engine with the adjusted linkage orientation may be imperceptible to the operator, fuel efficiency and engine emissions are affected. Similarly, an operator may adjust the throttle linkage outside of it's preferred operating range in a effort to improve the perceived operation of the engine. Such manipulation can result in damage to engine components not limited to the throttle assembly. Particularly in two-cycle engines where the fuel and air supplied to the engine perform cooling functions during operation, manipulation of the throttle assembly resulting in changes to the flow of combustion fluids through the engine can lead to overheating of engine components.

While many believe that two-stroke engines are generally not environmentally friendly engines, such preconceptions are misguided in light of contemporary two-stroke engines. Modern direct injected two-stroke engines and, in particular, Evinrude® outboard motors, are compliant with, not only today's emission standards, but emission standards well into the future. However, since these engines are so advanced, they require trained technicians perform certain repairs and adjustments. As such, a significant portion of the ability to adjust these motors has been eliminated or restricted to qualified personnel in an effort to ensure the future emission efficiency of the en- gines.

It would therefore be desirable to have a throttle linkage and method of manufacturing an engine with a throttle linkage where the throttle linkage has no means of adjustment.

BRIEF DESCRIPTION OF INVENTION

The present invention provides a throttle linkage and method of manufacturing an engine that solves the aforementioned problems. The present invention provides a throttle linkage having a plurality of throttle links. The throttle linkage is connectable between a throttle actuator and a throttle assembly and has a permanently set range of operation. Such a throttle linkage is permanently calibrated and tamper resistant.

In accordance with one aspect of the present invention, a throttle linkage for an outboard motor is disclosed which includes an input end and an output end. The input end of the throttle linkage is constructed to receive an operator throttle command initiated in a watercraft and the output end is constructed to be directly connected to a throttle assembly of an engine disposed in an outboard motor. A lever assembly having a plurality of lever arms is disposed between the input end and the output end wherein each lever arm and the lever assembly have no means for adjusting the lever assembly. Such a construction forms a throttle linkage that is nonadjustable.

According to another aspect of the present invention, a throttle linkage for an engine is disclosed that includes a first link, a second link, and a third link. The first link is rotatably attached to an engine and has a permanently fixed range of rotation. An input arm is integrally formed with the first link and connectable to a throttle cable. The second link also has a permanently fixed range of rotation and is engagable by an output arm of the first link. The third link is connected to an output arm of the second link and connected to a throttle assembly. Such a construction forms a throttle linkage without a variable, or adjustable, range of rotation.

In accordance with yet another aspect of the present invention, an internal combustion engine is disclosed which includes an engine block having at least one cylinder formed therein. A throttle assembly having an opening therethrough is in fluid communication with the at least one cylinder. A throttle linkage free of any form of adjustment is connected to the throttle assembly and is constructed to receive a throttle command. The throttle linkage has at least one link having an index integrally formed therewith. The index of the at least one link is constructed to directly engage an at least one throttle stop extending from the engine block. Such a construction forms a throttle linkage without an adjustment means disposed between the throttle link and the throttle stop.

According to a further aspect of the present invention, a method of manufacturing an engine is disclosed which includes the steps of: forming a throttle link having a tab; forming an engine block with at least one throttle boss; and attaching the throttle link to the engine with a permanently fixed range of movement and with the tab rotatably related permanently to the throttle boss.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
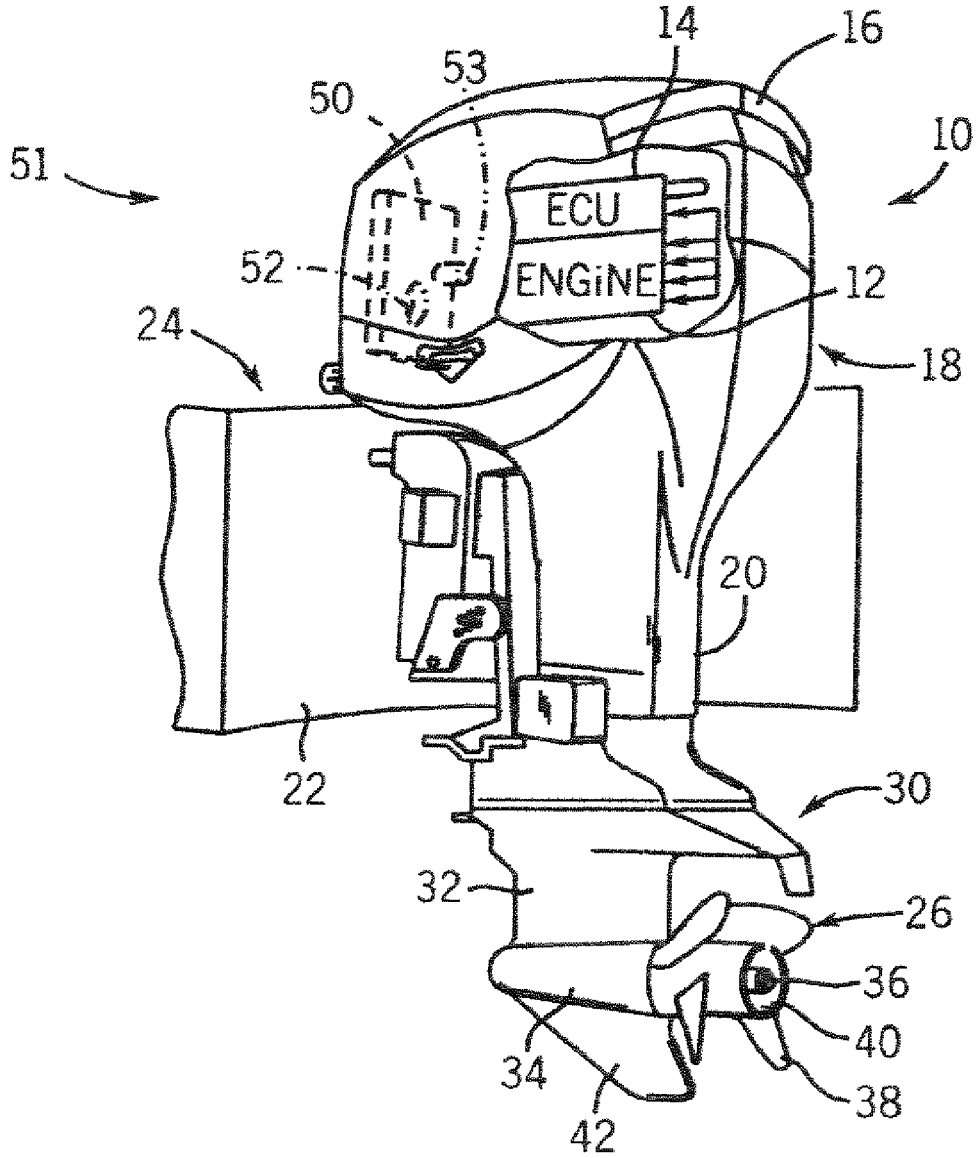
FIG. 1 is a perspective view of an exemplary outboard motor incorporating the present invention.

The present invention relates generally to internal combustion engines. In the present embodiment, the engine is a direct fuel injected, spark-ignited two-cycle gasoline-type engine. FIG. 1 shows an outboard motor 10 having one such engine 12 controlled by an electronic control unit (ECU) 14 under engine cover 16. Engine 12 is housed generally in a powerhead 18 and is supported on a mid-section 20 configured for mounting on a transom 22 of a boat 24 in a known conventional manner. Engine 12 is coupled to transmit power to a propeller 26 to develop thrust and propel boat 24 in a desired direction. A lower unit 30 includes a gear case 32 having a bullet or torpedo section 34 formed therein and housing a propeller shaft 36 that extends rearwardly therefrom. Propeller 26 is driven by propeller shaft 36 and includes a number of fins 38 extending outwardly from a central hub 40 through which exhaust gas from engine 12 is discharged via mid-section 20. A skeg 42 depends vertically downwardly from torpedo section 34 to protect propeller fins 38 and encourage the efficient flow of outboard motor 10 through water.

A throttle body 50 (shown in phantom), is connected to engine 12 and has at least one opening 52 passing therethrough. The number of openings generally corresponds to a number of cylinders in engine 12. Only one is shown for a two-cylinder engine for exemplary reasons. Opening 52 is often referred to as an air intake opening and allows combustion gas, generally air, to pass through throttle body 50 and into engine 12. Another opening 53, an idle air bypass, passes through throttle body 50 and provides an alternate path for combustion gas into and through throttle body 50. As will be described further below, opening 53 is constructed to provide combustion gas to engine 12 during idle and low speed operations.

Figure 2:
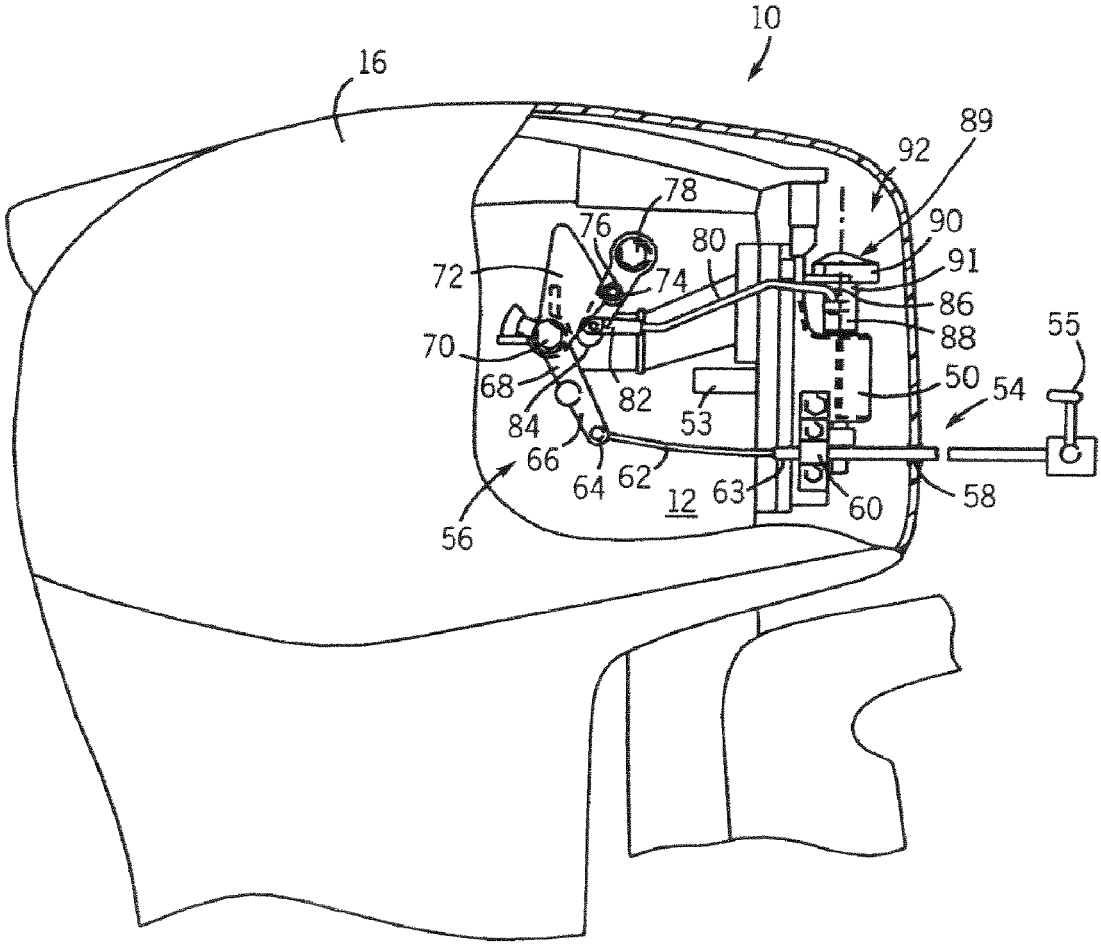
FIG. 2 is an elevational view of a portion of the outboard motor of FIG. 1 showing the throttle linkage and throttle assembly of the present invention.

FIG. 2 shows outboard motor 10 with a portion of engine cover 16 cut away. A throttle cable 54 connects a throttle actuator 55 to a throttle linkage assembly 56 so that throttle linkage assembly 56 is movable in response to operator manipulation of throttle actuator 55. Throttle cable 54 passes through an opening 58 formed in engine cover 16. A mounting bracket 60 secures throttle cable 54 to throttle body 50 and prevents movement therebetween. Throttle cable 54 has a cable 62 which extends from an end 63 thereof. Cable 62 extends and retracts from throttle cable 54 relative to mounting bracket 60 in response to operator manipulation of throttle actuator 55. An end 64 of cable 62 engages a first throttle link 66 of throttle linkage assembly 56. Cable end 64 is attached to a first arm 68 of first throttle link 66 so that movement of cable 62 results in rotation of first throttle link 66 about a pin or mounting bolt 70.

A second arm 72 of first throttle link 66 engages a pin 74 extending from a second throttle link 76 of throttle linkage assembly 56. Second throttle link 76 rotates about a pin 78 and has a third throttle link 80 attached thereto. A first end 82 of third throttle link 80 is connected to an end 84 of second throttle link 76. A second end 86 of third throttle link 80 is attached to an actuator 88 of a throttle assembly 92. During operation, as an operator advances throttle actuator 55, throttle cable 62 moves and rotates first throttle link 66 of throttle link assembly 56 about pin 70. Rotation of first throttle link 66 causes second arm 72 to engage pin 74 and thereby rotate second throttle link 76. Displacement of second throttle link 76 is translated to throttle assembly 92 via third throttle link 80 so that actuator 88 is coupled to throttle actuator 55. Such a linkage forms a throttle assembly that is highly responsive and sensitive to operator manipulation of a throttle actuator.

Referring to throttle assembly 92, a mount 89, preferably having a throttle position sensor (TPS) 90 inside, is connected proximate a first end 91 of actuator 88. The TPS 90 communicates the position of actuator 88 to the ECU of engine 12. In addition to the responsiveness of the throttle assembly, mounting TPS 90 about the actuator of the throttle assembly ensures that an ECU attached thereto is nearly instantaneously aware of operator manipulation of throttle actuator 55. Such a construction connects a throttle linkage assembly and throttle assembly with reduced play therebetween and allows an engine 12 so equipped to be highly responsive to actual throttle position.

Figure 3:
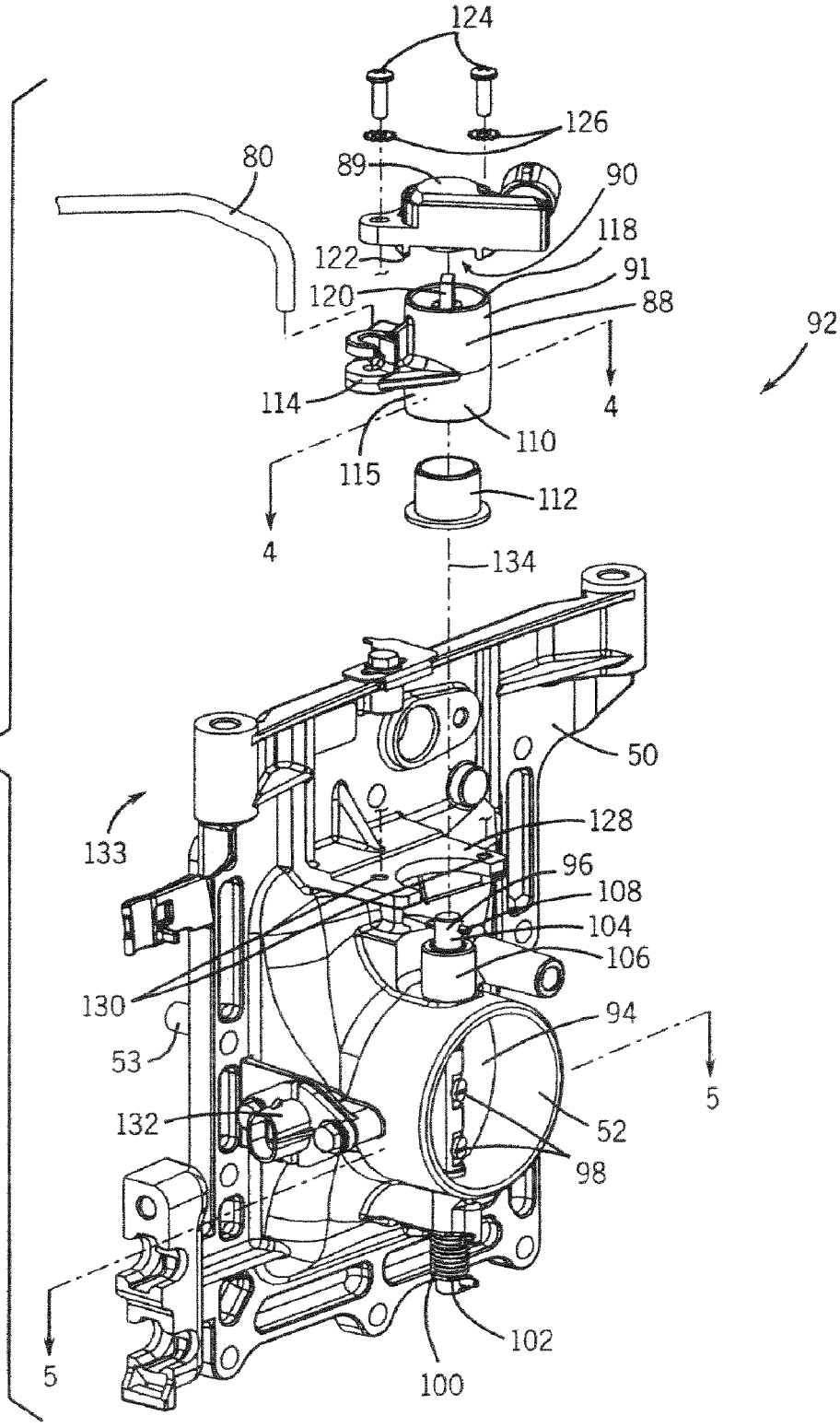
FIG. 3 is an exploded view of the throttle body and throttle assembly of FIG. 2.
Figure 5:
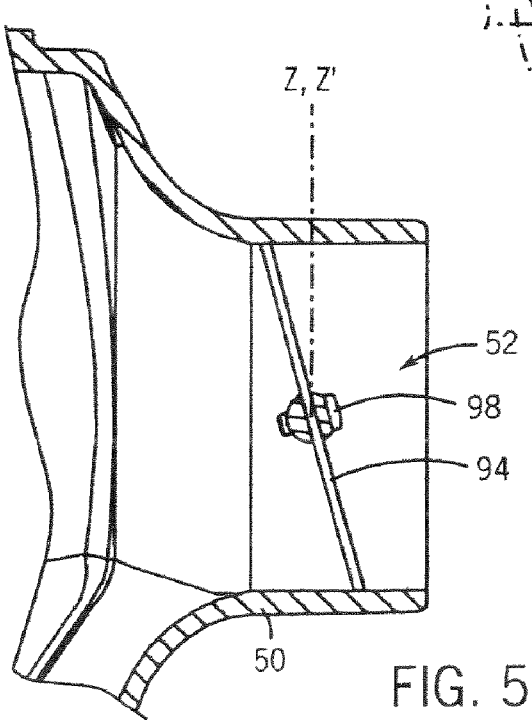
FIG. 5 is a cross-sectional view of a portion of the throttle assembly of FIG. 3 taken along line 5—5 and shows a closed throttle plate position.

FIG. 3 shows an exploded view of throttle assembly 92. Throttle body 50 is mounted to engine 12 with opening 52 in fluid communication with the combustion chambers of engine 12 and in general alignment with a front 51 of engine 12, as best viewed in FIG. 1. The front 55 of engine 12 is in linear alignment with an operator and passengers of watercraft 24. Referring back to FIG. 3, throttle plate 94 is rotatably positioned within opening 52 to regulate air flow through throttle body 50. During idle operation of engine 12, throttle plate 94 remains closed, as shown in FIGS. 3 and 5, and combustion gas is provided to engine 12 via an opening or idle air bypass 53. Opening 53 provides a path for combustion gas into engine 12 when throttle plate 94 prevents the passage of combustion gas through opening 52. Opening 53 is formed in throttle body 50 generally opposite air intake opening 52 and faces generally towards engine 12 and away from the operator and passengers of the watercraft or other recreational product.

Throttle plate 94 is secured to a throttle shaft 96 by a plurality of fasters 98 such that rotation of throttle shaft 96 results in rotation of throttle plate 94. A spring 100 is positioned about a first end 102 of throttle shaft 96 and biases throttle plate 94 to a closed position in opening 52, as shown in FIG. 3. A second end 104 of throttle shaft 96 extends through a mount structure 106 of throttle body 50. A pin 108, preferably a roll pin, extends through throttle shaft 96 and engages a second end 110 of actuator 88. A bushing 112 is constructed to fit about mount 106 and facilitates rotation of actuator 88 relative thereto.

Third throttle link 80 engages an arm 114 of actuator 88. Arm 114 is integrally formed with actuator 88 and extends from a body 115 thereof. By extending from body 115 of actuator 88, arm 114 allows for a generally linear translation of third throttle link 80 to rotate actuator 88. Body 115 has a generally cylindrical shape and extends from first end 91 of actuator 88 to second end 110. First end 91 of actuator 88 has a bearing surface 118 thereabout and an extension, or tab 120, extending therefrom. Tab 120 is constructed to engage throttle position sensor 90 located within mount 89 such that movement of actuator 88 results in a change of signal from throttle position sensor 90. Throttle position sensor 90 is within a mount 89 positioned about first end 91 of actuator 88. It is understood that in those applications where a throttle position sensor is mounted remotely relative to a throttle shaft that throttle position sensor 90 can be merely a molded mount attachable to the throttle body and constructed to support an end of the actuator therebetween.

A flange 122 of TPS mount 89 engages bearing surface 118 of actuator 88 and maximizes a frictionless rotational engagement therebetween. A plurality of fasteners 124 and corresponding washers 126 secure TPS mount 89 to throttle body 50 at a boss, or mounting flange 128, extending from throttle body 50. Mounting flange 128 includes a pair of holes 130 constructed to receive fasteners 124 therein to secure TPS mount 89 to throttle body 50 with actuator 88 disposed therebetween. Actuator 88 is free to rotate relative to throttle body 50 and TPS mount 89. As such, operator manipulation of throttle actuator 55, show in FIG. 2, moves third throttle link 80 which in turn rotates actuator 88 relative to throttle body 50 and TPS mount 89.

A temperature probe 132 extends through throttle body 50 into air intake opening 52 on an engine side 133 of throttle plate 94 and is in electrical communication with ECU 14 shown in FIG. 2. Referring back to FIG. 3, temperature probe 132 is positioned in air intake opening 52 such that it does not interfere with rotation of throttle plate 94. Temperature probe 132 communicates to the ECU a temperature of combustion air provided to the engine to allow the ECU to more effectively control overall engine efficiency and, particularly, fuel combustion efficiency.

Actuator 88, TPS mount 89, bushing 112, and throttle shaft 96 all share a common axis 134. Common axis 134 is the axis of rotation of throttle shaft 96 to which throttle plate 94 is mounted. Although mounted about throttle shaft 96 and directly responsive to operator movement of throttle actuator 55, actuator 88 is partially rotatable about common axis 134 without affecting the position of throttle plate 94. That is, throttle plate 94 remains closed, as shown in FIG. 3, through a predetermined range of operator movement of throttle actuator 55, yet the RPM of the engine increases, as will be described in further detail below with respect to FIGS. 4–9.

Figure 4:
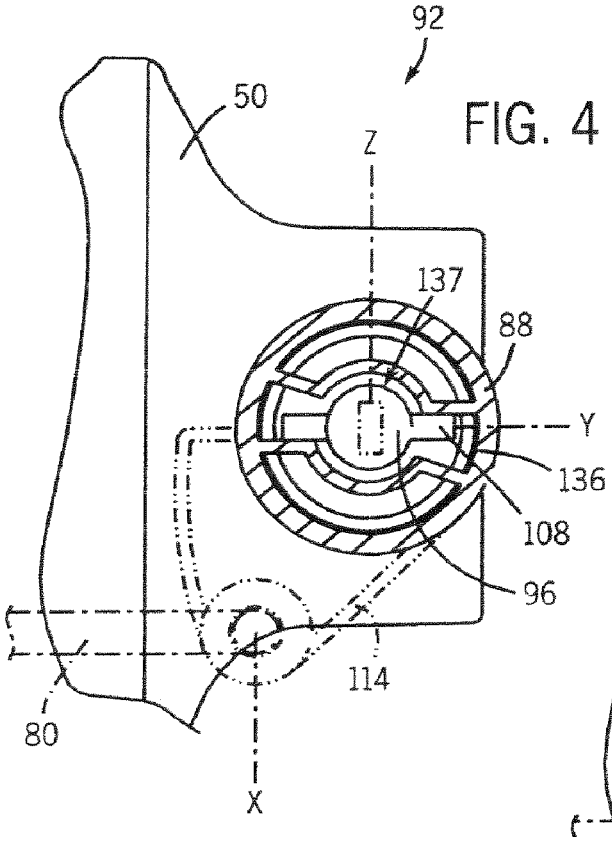
FIG. 4 is a cross-sectional view of a portion of the throttle assembly of FIG. 3 taken along line 4—4 and shows a throttle assembly idle position.

As shown in FIG. 4, when assembled, throttle shaft 96 and pin 108 of throttle assembly 92 are positioned in a recess 136 of actuator 88. Recess 136 has a bowtie shaped cross-section 137 that allows partial rotation of pin 108 and shaft 96 relative thereto. Although shown having a bowtie shaped cross-section it is understood that such a cross-section is merely by way of example and that other arrangements could be used to achieve the result of allowing actuator 88 to determinably engage and disengage from a driving relationship with throttle shaft 96, thereby providing a "deadband" in the throttle linkage. An example of such an arrangement would be a portion of the recess constructed to receive the throttle shaft and another portion of the recess constructed to receive a keying element such as one end of a pin extending from the shaft.

Figure 6:
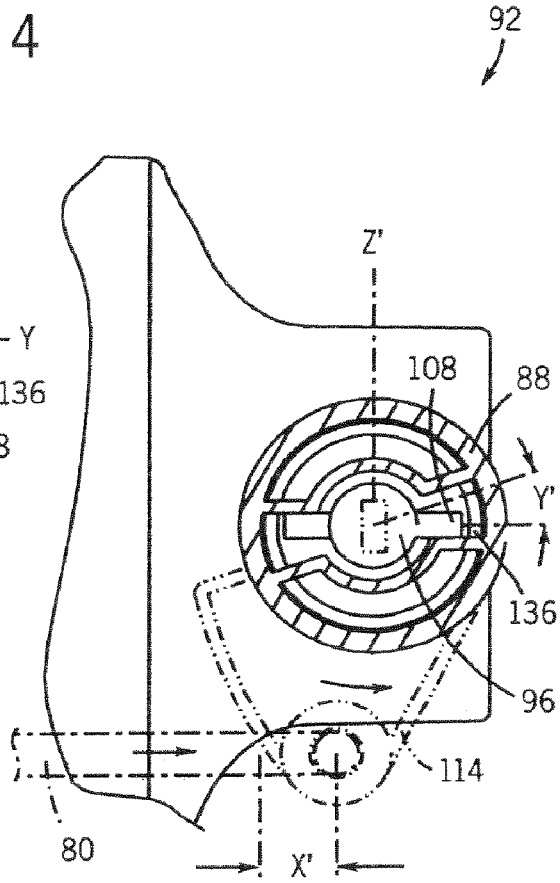
FIG. 6 is a view similar to FIG. 4 and shows the throttle assembly in a throttle assembly transition position.

The relation of actuator 88 to pin 108, as shown in FIG. 4, indicates an idle throttle position. Comparing FIG. 4 to FIG. 6, as an operator advances throttle actuator 55, third throttle link 80 is advanced a distance of X', as shown in FIG. 6. The relation of actuator 88 to pin 108, as shown in FIG. 6 indicates a transition throttle position. The transition throttle position is generally defined as the point during engine operation where the combustion process preferably transitions from a stratified combustion operation to a homogeneous combustion operation wherein stratified and homogenous define the type of combustion charge supplied to the engine, as is known in the art.

The displacement of third throttle link 80 distance X' results in rotation of actuator 88 but does not move pin 108 or throttle shaft 96. When third throttle link 80 is displaced distance X', actuator 88 rotates a distance Y'. In one embodiment, distance Y' is not more than 35 degrees and is preferably approximately 19 degrees. During operation, although an operator has advanced throttle actuator 55 and displaced third throttle link 80 a distance of X', as shown in comparing FIGS. 4 and 6, recess 136 prevents actuator 88 from displacing throttle shaft 98. As such, throttle plate 94 remains closed, as shown in FIG. 5, as actuator 88 is rotated relative thereto. Such a construction forms the deadband in the throttle assembly. One exemplary explanation of the deadband is where the throttle assembly receives an input command having a value of X' and throttle plate 94 does not experience a corresponding output. Such a construction allows throttle plate 94 to remain closed for a predetermined range of engine operation, not merely an engine idle condition.

Throttle plate 94 remains closed, as shown in FIG. 5, up to the transition of throttle position shown in FIG. 6. By maintaining throttle plate 94 closed until approximately the point the engine requires a homogenous combustion charge, a minimum amount of engine noise is allowed to exit the engine through air intake opening 52, while air bypass 53 is sized large enough to provide an adequate charge. By the time that the engine requires a generally homogenous combustion charge, and the throttle plate begins to open with further advancement of the throttle actuator, the overall operating noise of the engine reaches a level that overcomes any noise that may exit the engine through the air intake opening 50. Maintaining throttle plate 94 closed beyond engine idle speed reduces the overall amount of engine noise allowed to exit the engine through air intake opening 52.

Figure 7:
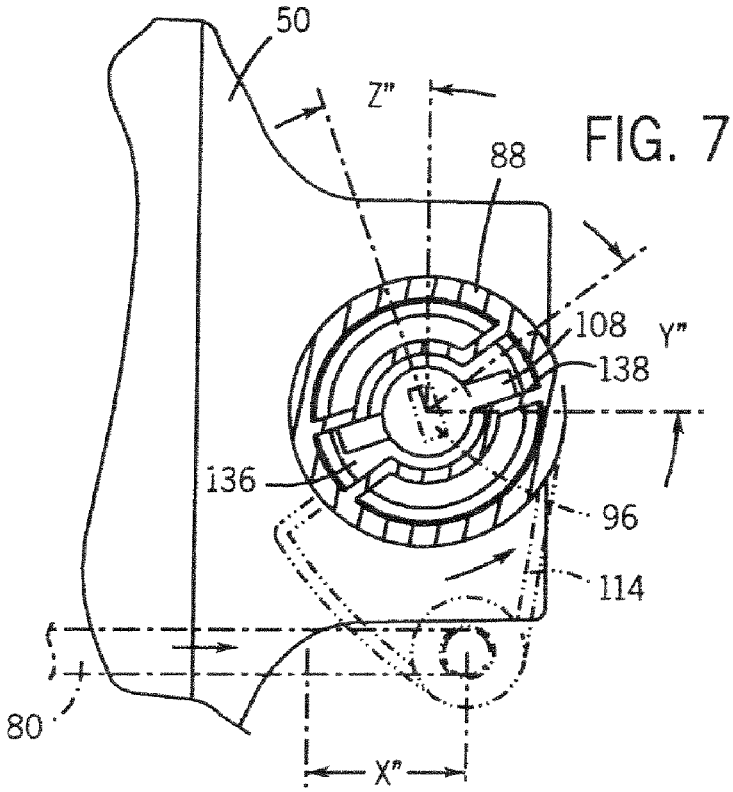
FIG. 7 is a view similar to FIGS. 4 and 5 and shows the throttle assembly rotated past the throttle assembly transition position.
Figure 8:
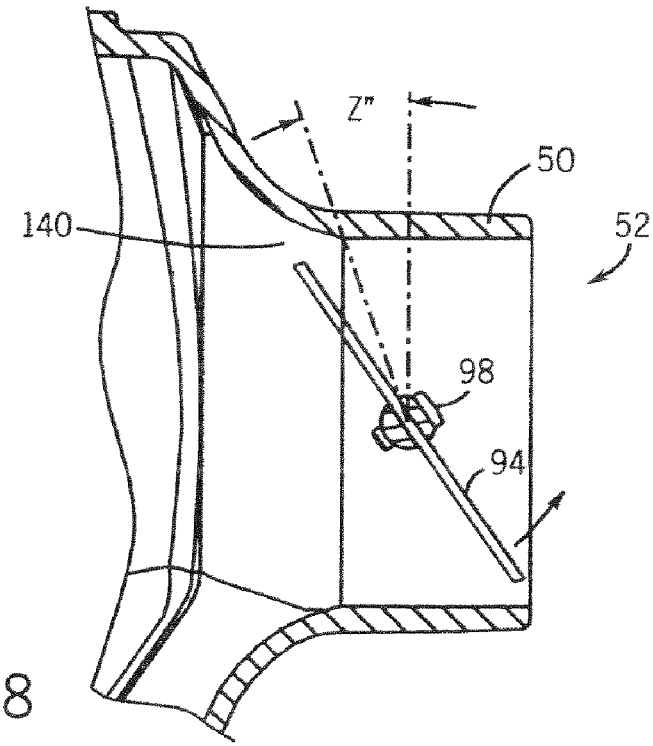
FIG. 8 is a view similar to FIG. 5 and shows the throttle assembly with the throttle plate rotated beyond the closed throttle plate position.

Comparing FIGS. 6 and 7, as an operator advances the throttle actuator beyond a distance X', shown in FIG. 6, any further increase in the position of the throttle actuator provides a corresponding rotation of throttle shaft 96 and opens throttle plate 94. As shown in FIG. 7, as third throttle link 80 is advanced a distance X", actuator 88 is rotated an angle of Y" while throttle shaft 96 rotates an angle of Z". The difference between Y" and Z" is equal to the amount of deadband engagement—distance Y', as shown in FIG. 6, between actuator 88 and throttle plate 94. Once third throttle link 80 is displaced a distance greater than X', as shown in FIG. 6, any further displacement of third throttle link 80 results in rotation of throttle shaft 96, as shown in FIG. 7. A leading edge 138 of recess 136 engages pin 108 and rotates throttle shaft 96. As leading edge 138 comes into contact with pin 108, as shown in FIGS. 7 and 8, throttle plate 94 rotates relative to opening 52 of throttle body 50. As shown in FIG. 8, when the throttle actuator is advanced beyond the transition throttle position, throttle plate 94 rotates to an open position, indicated by a gap 140 formed between throttle plate 94 and throttle body 50, allowing combustion gas to pass through opening 52.

Figure 9:
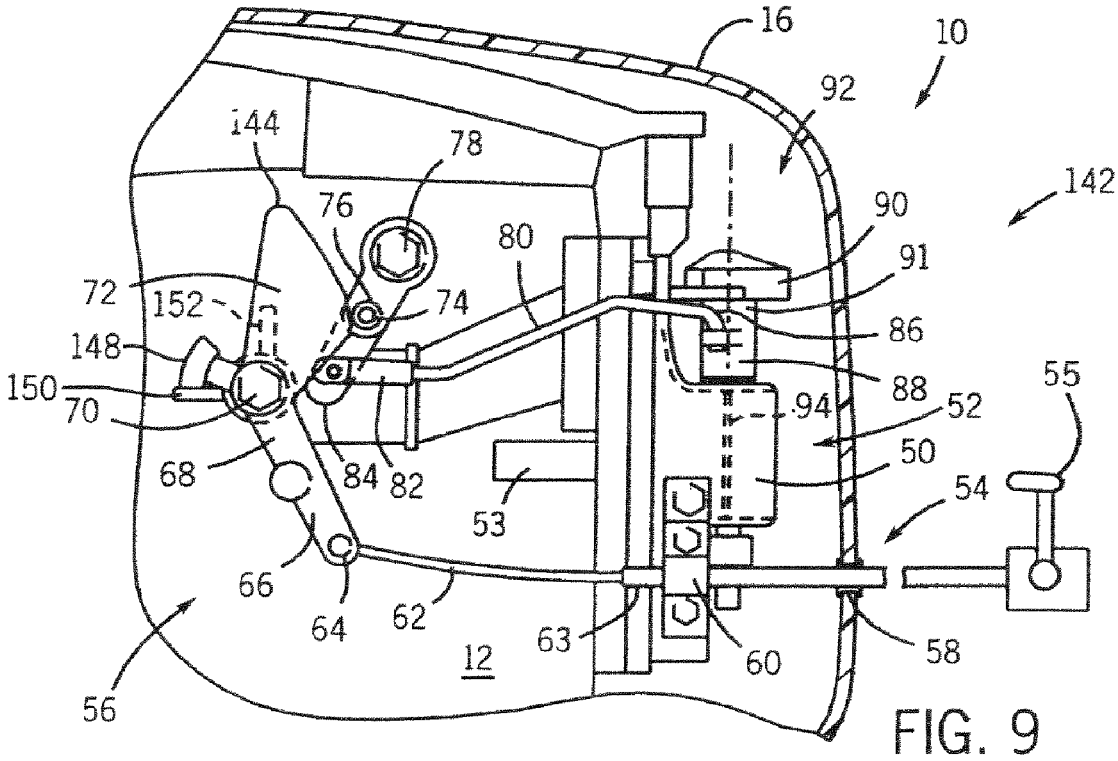
FIG. 9 is a detail view of the throttle assembly of FIG. 2 with the throttle actuator, throttle linkage assembly, and throttle assembly in an idle throttle position.

During idle operation of outboard motor 10, as shown in FIG. 9, when throttle actuator 55 is in an idle throttle position 142, throttle plate 94 is disposed generally across opening 52 thereby preventing the passage of combustion gas therethrough. Opening 53 provides combustion gas to pass through throttle body 50 thereby providing idle operation combustion gas to engine 12. Second arm 72 of first throttle link 66 includes a cam, or cam face 144 constructed to engage pin 74 of second throttle link 76.

Figure 10:
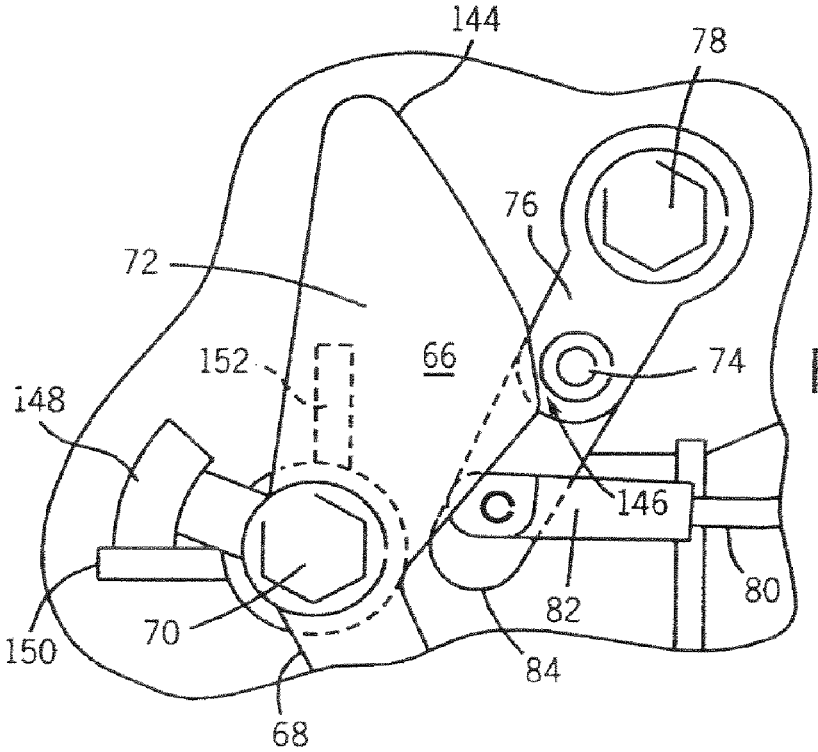
FIG. 10 is a detail view of the throttle linkage assembly in the idle throttle position as shown in FIG. 9.
Figure 12:
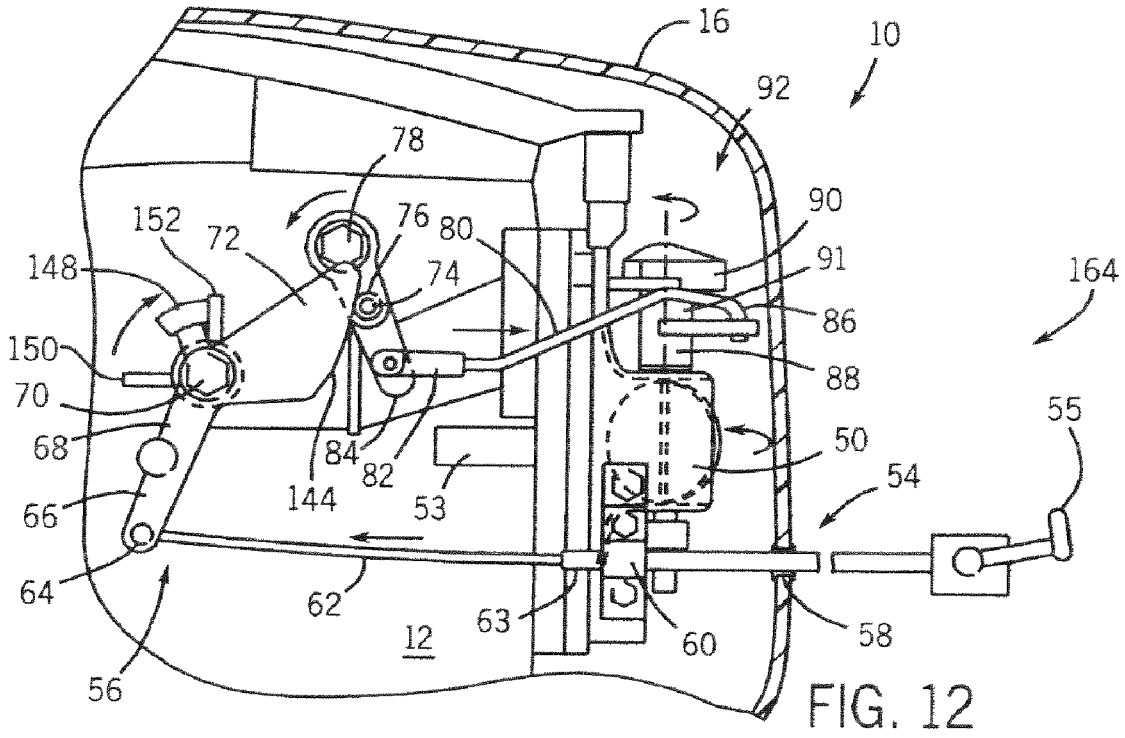
FIG. 12 is a detail view showing the throttle actuator, throttle linkage assembly, and throttle assembly of FIG. 9 advanced to a wide open throttle position.

As shown in FIG. 10, at idle operation of engine 12, a small gap 146 is formed between cam face 144 of first throttle link 66 and pin 78 of second throttle link 76. First throttle link 66 includes a tab, or third arm 148 integrally formed therewith. Third arm 148 is constructed to engage a first throttle stop 150 and a second throttle stop 152. Throttle stops 150, 152 are integrally formed with engine 12 and restrict the movement of throttle linkage 56 and define an idle throttle linkage position, as shown in FIGS. 9 and 10, and a wide open throttle linkage position, as shown in FIG. 12. Such a construction forms a throttle linkage assembly having no means of adjustment and wherein the range of rotation of each of the links of the throttle linkage assembly is permanently fixed.

Referring back to FIG. 9, with throttle actuator 55 in idle throttle position 142, third arm 148 of first throttle link 66 abuts first throttle stop 150 thereby permanently fixing the engine idle throttle linkage positions. Cam face 144 of second arm 72 of first throttle link 66 disengages from pin 74 with gap 146 therebetween. During idle throttle position 142, second throttle link 76, third throttle link 80, and actuator 88 are maintained in an idle position and mechanically separated from throttle actuator 55 by gap 146 between first and second throttle links 66, 76.

Figure 11:
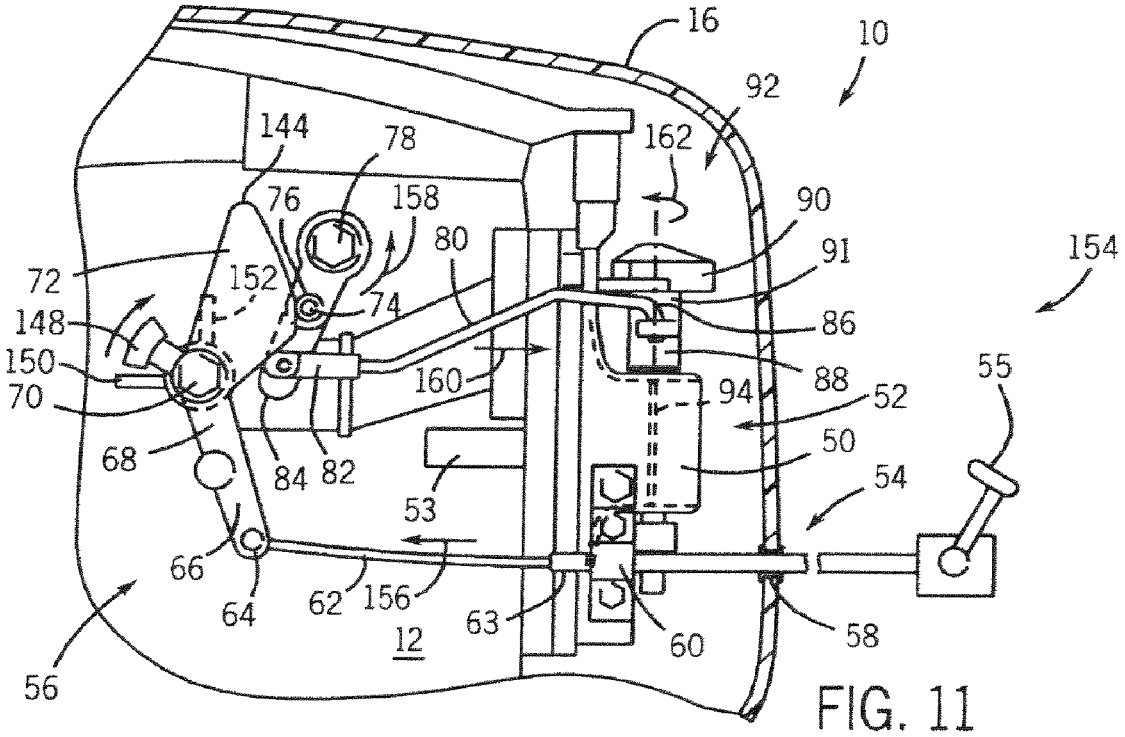
FIG. 11 is a detail view showing the throttle actuator, throttle linkage assembly, and throttle assembly of FIG. 9 advanced to an engine transition position.

As shown in FIG. 11, throttle actuator 55, throttle linkage assembly 56, throttle assembly 92 have been advanced to their respective engine transition positions 154. Throttle actuator 55 is shown advanced to a transition displacement, indicated by arrow 156, of throttle cable 62. Displacement 156 rotates first throttle link 66 such that third arm 148 disengages from first throttle stop 150 and rotates toward second throttle stop 152. Cam face 144 engages pin 74 of second throttle link 76 and slides there along rotating second throttle link about pin 78. Second throttle link 76 rotates in the direction of arrow 158 and displaces third throttle link 80 in the direction of arrow 160. Displacement 160 of third throttle link 80 rotates actuator 88 indicated generally by arrow 162.

Throttle position sensor 90 signals to the ECU the movement 162 of actuator 88. The ECU, in response to the signal from throttle position sensor 90, adjusts predetermined engine operating parameters. One of the engine parameters that is adjusted is the amount of fuel provided to the engine. The amount of fuel provided to the engine is increased in response to the throttle actuator adjustment. By adjust the amount of fuel provided to the engine at transition throttle position 154, the operating speed of the engine is increased. Even though the operating speed and the amount of fuel provided to the engine is increased, from idle throttle position 142, shown in FIG. 9, to transition throttle position 154 shown in FIG. 11, throttle plate 94 remains closed. This is accomplished because the air bypass 53 allows sufficient air induction into the engine via a second opening.

FIG. 12 shows a wide open throttle position 164. Throttle actuator 55 is fully advanced. Third arm 148 of first throttle link 66 is rotated into contact with second throttle stop 152. Second throttle stop 152 permanently fixes the position of throttle linkage assembly 56 and throttle assembly 92 during wide open throttle operation. Third throttle link 80 rotates actuator 88 beyond transition throttle position 154, as shown in FIG. 11, so that actuator 88 engages throttle plate 94. As shown in FIGS. 11 and 12, when the throttle actuator is advanced beyond transition throttle position 154 to wide open throttle position 164, throttle plate 94 rotates approximately 90 degrees relative to opening 52 thereby allowing combustion gas to pass therethrough. As engine 12 needs more combustion gas to mix with the fuel in order to transition from the stratified combustion stage to a homogeneous combustion stage, throttle plate 94 rotates in opening 52 to allow more combustion gas to pass therethrough. By maintaining the throttle plate closed across opening 52 during relatively low speed operation of engine 12, throttle assembly 92 reduces the amount of engine noise emitted toward an operator.

Therefore, in accordance with one embodiment of the present invention, a throttle linkage for an outboard motor includes an input end and an output end. The input end of the throttle linkage is constructed to receive an operator throttle command initiated in a watercraft and the output end is constructed to be directly connected to a throttle assembly of an engine disposed in an outboard motor. A lever assembly having a plurality of lever arms is disposed between the input end and the output end wherein each lever arm and the lever assembly have no means for adjusting the lever assembly.

According to another embodiment of the present invention, a throttle linkage for an engine includes a first link, a second link, and a third link. The first link is rotatably attached to an engine and has a permanently fixed range of rotation. An input arm is integrally formed with the first link and connectable to a throttle cable. The second link also has a permanently fixed range of rotation and is engagable by an output arm of the first link. The third link is connected to an output arm of the second link and connected to a throttle assembly.

In accordance with yet another embodiment of the present invention, an internal combustion engine includes an engine block having at least one cylinder formed therein. A throttle assembly having an opening therethrough is in fluid communication with the at least one cylinder. A throttle linkage free of any form of adjustment is connected to the throttle assembly and is constructed to receive a throttle command. The throttle linkage has at least one link having an index integrally formed therewith. The index of the at least one link is constructed to directly engage an at least one throttle stop extending from the engine block.

According to a further embodiment of the present invention, a method of manufacturing an engine includes the steps of: forming a throttle link having a tab; forming an engine block with at least one throttle boss; and attaching the throttle link to the engine with a permanently fixed range of movement and with the tab rotatably related permanently to the throttle boss.

While the present invention is shown as being incorporated into an outboard motor, the present invention is equally applicable with many other applications and recreational products, some of which include inboard motors, snowmobiles, personal watercrafts, all-terrain vehicles (ATVs), motorcycles, mopeds, lawn and garden equipment, generators, etc.

The present invention has been described in terms of the preferred embodiment, and it is recognized that equivalents, alternatives, and modifications, aside from those expressly stated, are possible and within the scope of the appending claims. While the present invention is shown as being incorporated into an outboard motor, the present invention is equally applicable with other recreational products, some of which include inboard motors, snowmobiles, personal watercrafts, all-terrain vehicles (ATVs), motorcycles, mopeds, power scooters, and the like. Therefore, it is understood that within the context of this application, the term "recreational product" is intended to define products incorporating an internal combustion engine that are not considered a part of the automotive industry. Within the context of this invention, the automotive industry is not believed to be particularly relevant in that the needs and wants of the consumer are radically different between the recreational products industry and the automotive industry. As is readily apparent, the recreational products industry is one in which size, packaging, and weight are all at the forefront of the design process, and while these factors may be somewhat important in the automotive industry, it is quite clear that these criteria take a back seat to many other factors, as evidenced by the proliferation of larger vehicles such as sports utility vehicles (SUV).

What is claimed is:

1. A throttle linkage for an outboard motor comprising:

an input end constructed to receive an operator throttle command initiated in a watercraft;

an output end constructed to be directly connected to a throttle assembly of an engine disposed in an outboard motor;

the throttle assembly having a throttle plate and a mechanical deadband between the output end and the throttle plate; and a lever assembly having a plurality of lever arms disposed between the input end and the output end, each lever arm and the lever assembly being free of any form of adjustment.

2. The throttle linkage of claim 1 wherein the plurality of arms includes an input arm, an engagement output arm, and an index arm integrally connected to form a first member.

3. The throttle linkage of claim 2 further comprising a second member having a pin arm constructed to engage the engagement output arm of the first member and a connecting rod arm connected to a bar arm.

4. The throttle linkage of claim 3 wherein the engagement output arm is engaged to the pin arm in a cam-follower relationship.

5. The throttle linkage of claim 1 attached to a two-stroke engine having a plurality of integrally formed throttle stops constructed to engage a portion of at least one of the levers.

6. The throttle linkage of claim 1 wherein the plurality of lever arm includes an input lever having a first arm connectable to a throttle cable.

7. The throttle linkage of claim 6 wherein the input lever further comprises a second arm having a cam face engageable with an output lever of the nonadjustable lever assembly.

8. The throttle linkage of claim 6 wherein the input lever further comprises a second arm disposable between a first and a second throttle stop wherein the throttle stops are integrally formed in an engine block.

9. The throttle linkage of claim 1 wherein the nonadjustable lever assembly further comprises a first lever and a second lever wherein each lever has a nonadjustable range of rotation.

10. The throttle linkage of claim 1 incorporated into an outboard motor.

11. A throttle linkage for an engine comprising:

a first link rotatably attached to an engine and having a permanently fixed range of rotation;

an input arm integrally formed with the first link and connected to a throttle cable;

a second link having a permanently fixed range of rotation and engageable by an output arm of the first link;

a third link connected to an output arm of the second link and connected to a throttle assembly; and the throttle assembly having an actuator connected between the third link and a throttle plate wherein the actuator disengages the throttle plate from the third link during a portion of the permanently fixed range of rotation of the second link.

12. The throttle linkage of claim 11 wherein an output arm of the first link passes over a plane of rotation of the second link.

13. The throttle linkage of claim 11 wherein an engagement arm of the second link extends generally perpendicular to a plane of rotation of the first link and a plane of rotation of the second link.

14. The throttle linkage of claim 11 wherein the third link has a first end connected to an output end of the second link and a second end connected to an input arm of the actuator.

15. The throttle linkage of claim 11 wherein the permanently fixed range of rotation of the first link is larger than the permanently fixed range of rotation of the second link and allows for disengagement therebetween.

16. The throttle linkage of claim 11 wherein the permanently fixed range of rotation of the first link is determined by a plurality of throttle stops extending from the engine.

17. The throttle linkage of claim 11 wherein the throttle assembly further comprises a throttle body connected to the engine and having a first opening with the throttle plate disposed therein and a second unobstructed opening passing therethrough.

18. The throttle linkage of claim 11 wherein the first link further comprises an index arm integrally formed with the first link and engageable with an idle throttle stop and a wide open throttle stop.

19. The throttle linkage of claim 18 further comprising a pin extending from a face of the second link, the pin constructed to engage a cam face of the first link.

20. The throttle linkage of claim 11 wherein the first link and the second link have an opening formed therethrough, each opening constructed to receive a fastener therethrough, to rotatably secure each link to the engine.

21. The throttle linkage of claim 11 wherein the third link has a fixed length and is disposed between an output end of the second link and the throttle assembly.

22. An internal combustion engine comprising:

an engine block having at least one cylinder formed therein;

a throttle stop extending from the engine block;

a throttle assembly having an opening therethrough in fluid communication with the at least one cylinder;

a throttle linkage connected to the throttle assembly and constructed to receive a throttle command, the throttle linkage having at least one link having an index integrally formed therewith and constructed to directly engage the at least one throttle stop; and a throttle plate rotalably positioned in the opening of the throttle assembly, the throttle plate disengaged from the throttle linkage during a portion of a range of movement of the throttle linkage, wherein the throttle linkage is free of any form of adjustment.

23. The internal combustion engine of claim 22 further comprising another throttle stop wherein both throttle stops are integrally formed with the engine block.

24. The internal combustion engine of claim 22 wherein the throttle linkage further comprises another link, each link independently rotatably secured to the engine block allowing a separation therebetween.

25. The internal combustion engine of claim 24 wherein the separation occurs when the index engages the at least one throttle stop.

26. The internal combustion engine of claim 22 wherein the index extends in a direction generally transverse to a plane of rotation of the at least one link.

27. The internal combustion engine of claim 22 wherein the at least one link has a cam surface constructed to engage a pin extending from another link, a portion of the at least one link bypassing a portion of the another link during rotation of either link.

28. The internal combustion engine of claim 22 further comprising another opening through the throttle assembly on a side of the throttle assembly generally opposite the first opening therethrough.

29. A method of manufacturing an engine comprising the steps of:

forming a throttle link having a tab;

forming an engine block with at least two throttle bosses; and attaching the throttle link to the engine with a permanently fixed range of movement and with the tab rotatably positioned between the at least two throttle bosses so that the tab engages one throttle boss when a throttle plate is at an idle position and engages the other throttle boss when the throttle plate is at a wide open throttle position.

* * * * *